US008302231B2

(12) United States Patent
Moffitt et al.

(10) Patent No.: US 8,302,231 B2
(45) Date of Patent: Nov. 6, 2012

(54) MEDICAL UNIT ATTACHMENT SYSTEM AND METHOD

(75) Inventors: Michael S Moffitt, Salt Lake City, UT (US); Andrew J Moffitt, Salt Lake City, UT (US); Michael J Reynolds, Salt Lake City, UT (US)

(73) Assignee: Gold Cross Services, Inc., Salt Lake City, UT (US)

( * ) Notice: Subject to any disclaimer, the term of this patent is extended or adjusted under 35 U.S.C. 154(b) by 568 days.

(21) Appl. No.: 12/563,418

(22) Filed: Sep. 21, 2009

(65) Prior Publication Data

US 2010/0084526 A1 Apr. 8, 2010

Related U.S. Application Data

(60) Provisional application No. 61/103,158, filed on Oct. 6, 2008.

(51) Int. Cl.
*A61G 1/04* (2006.01)
*A61G 7/00* (2006.01)

(52) U.S. Cl. ..... 5/658; 5/503.1; 5/86.1

(58) Field of Classification Search ..... 5/503.1, 5/507.1, 658, 8, 625, 626, 86.1; 296/20; 248/309.2; 108/28, 49
See application file for complete search history.

(56) References Cited

U.S. PATENT DOCUMENTS 4,037,871 A 7/1977 Bourgraf et al.
4,352,991 A * 10/1982 Kaufman ..... 307/9.1
4,557,453 A * 12/1985 McCloskey ..... 248/287.1
4,569,095 A 2/1986 Holling
4,783,109 A * 11/1988 Bucalo ..... 296/20
4,979,520 A 12/1990 Boone, Jr. et al.
5,069,465 A 12/1991 Stryker et al.
5,076,515 A 12/1991 Goon
5,490,703 A 2/1996 Hewko
5,522,100 A 6/1996 Schilling et al.
5,575,026 A 11/1996 Way et al.
5,590,431 A 1/1997 O'Connell
5,860,176 A 1/1999 Norberg
6,234,551 B1 5/2001 Matsumura
6,546,577 B1 4/2003 Chinn
6,701,545 B1 3/2004 Ferneau et al.
6,735,794 B1 5/2004 Way et al.
6,842,922 B2 * 1/2005 Smeed ..... 5/503.1
6,898,811 B2 5/2005 Zucker et al.
7,124,456 B2 10/2006 Palmatier et al.
7,131,151 B2 11/2006 Ferneau et al.
7,376,992 B2 * 5/2008 Salt et al. ..... 5/626
7,627,915 B2 * 12/2009 Eriksson ..... 5/625

* cited by examiner

*Primary Examiner* — Michael Trettel
(74) *Attorney, Agent, or Firm* — Snell & Wilmer L.L.P.

(57) ABSTRACT

An attachment system and method for attaching a medical unit to a transport using connection brackets. The medical unit attaches to the connection brackets and restricts the movement of the medical unit during transportation. Use of the connection brackets enables quick and efficient attachment and removal of the medical unit from the transport. A connection bracket may be placed at one end of the transport and the medical unit may be attached to the connection bracket. Once the medical unit is placed on the transport, another connection bracket may be attached to the medical unit and connected to the transport. After the second connection bracket is connected, the medical unit can be transported to another location.

18 Claims, 8 Drawing Sheets

TOP VIEW

SIDE VIEW

MEDICAL UNIT ATTACHMENT SYSTEM AND METHOD

CROSS REFERENCE TO RELATED APPLICATIONS

This application claims priority to and is a non-provisional of U.S. Provisional No. 61/103,158 filed on Oct. 6, 2008 and entitled "METHOD AND DEVICE FOR CONNECTING A MEDICAL UNIT TO A TRANSPORT." This provisional application is hereby incorporated by reference in its entirety.

TECHNICAL FIELD

The present disclosure relates to transports used in the medical emergency field. More particularly, the disclosure relates to methods and systems for connecting a portable medical unit to a transport.

BACKGROUND

Transportation of a medical patient is common during emergency situations. Typically, an adult patient is attached to a stretcher during transportation, either by ground or by air. Most stretchers have a collapsible structure with wheels to enable moving the patient smoothly between locations. Furthermore, it is important to keep the patient secure and stable during the transportation between locations.

Sometimes the patient is positioned on or in an additional medical unit, and the medical unit itself is attached to a stretcher for transportation. Additionally, the medical unit may be attached directly to a transport, either ground or air. For example, an infant who requires a Neonatal Intensive Care Unit (NICU) must remain inside the NICU while being transported to a different location. Similar to the typical adult situation, such medical units should be securely attached to the transport stretcher. Currently, it is common for medical units to be strapped to a stretcher, using a harness or other similar device. A harness must be fitted through attachment points along the medical unit and then tied or otherwise secured to the stretcher. However, during emergency situations the amount of time spent transporting a patient is critical. Reducing the time necessary to secure a medical unit to a transport, or to release it, increases the efficiency of receiving medical attention. Further, various harness systems fail to fully secure medical units to transports. Therefore, there is a need for a system and method of quickly and securely attaching a medical unit to a transport.

SUMMARY

An attachment system and method for attaching a medical unit to a transport are disclosed. In an exemplary embodiment, a medical unit attachment system comprises a transport having a first end and a second end, and a connection system having a first bracket and a second bracket. The first bracket securely connects to the first end of the transport, and the second bracket securely connects to the second end of the transport. The medical unit attachment system further comprises a medical unit having a first end, a second end, a first attachment point, and a second attachment point. The first attachment point connects to the first end and the second attachment point connects to the second end. The first attachment point attaches to the first bracket and the second attachment point attaches to the second bracket in order to facilitate securing the medical unit to the transport.

In another exemplary embodiment, a method of attaching a medical unit to a transport comprises equipping the medical unit with a first attachment point and a second attachment point, attaching a first connection bracket to a first end of the transport, moving the medical unit in a direction substantially coplanar with the first connection bracket until the first attachment point connects to the first connection bracket, positioning a second connection bracket in connection with the second attachment point, and attaching the second connection bracket to a second end of the transport while maintaining the connection between the second connection bracket and the second attachment point.

In another exemplary embodiment, a method of attaching a medical unit to a transport comprises equipping a bottom plane of the medical unit with a first attachment point and a second attachment point, attaching a first connection bracket to a top plane of the transport at a first end of the transport, moving the medical unit in a direction substantially parallel with the top plane of the transport until the first attachment point at least partially connects to the first connection bracket of the transport, moving the medical unit to substantially align the bottom plane to the top plane, moving a second connection bracket until the second connection bracket at least partially connects to the second attachment point, and attaching the second connection bracket to the transport at a second end of the transport while maintaining the connection between the second connection bracket and the second attachment point.

The contents of this summary section are provided only as a simplified introduction to the disclosure, and are not intended to be used to limit the scope of the appended claims.

BRIEF DESCRIPTION OF THE DRAWINGS

With reference to the following description, appended claims, and accompanying drawings:

DETAILED DESCRIPTION

The following description is of various exemplary embodiments only, and is not intended to limit the scope, applicability or configuration of the present disclosure in any way.

Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for transportation, coupling, fastening, shock absorption, and/or the like may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical medical unit attachment system.

A medical unit attachment system may be any system configured to facilitate coupling a medical unit to a transport. In accordance with an exemplary embodiment, and with reference to FIG. 1, a medical unit attachment system 100 generally comprises a transport component 100A, a medical unit component 100B, and a coupling component 100C. Transport component 100A is configured to facilitate support, movement, coupling, transportation and/or other desired actions for a medical unit. For example, transport component 100A may comprise a stretcher, an ambulance, a helicopter, an airplane, and/or the like. Medical unit component 100B is configured to be releasably coupled to transport component 100A, and is configured to assist, monitor, stabilize, protect, incubate, and/or otherwise perform a desired medical function for a patient. For example, medical unit component 100B may comprise any machine, medical equipment, and/or combination and/or collection of the above desired to be securely attached to a transport. Connection component 100C is configured to releasably couple transport component 100A and medical unit component 100B. For example, connection component 100C may comprise one or more coupling mechanisms, such as fasteners, brackets, clasps, bindings, and/or the like. Connection component 100C is further configured to restrict movement of medical unit component 100B with respect to transport component 100A.

Figure 1:
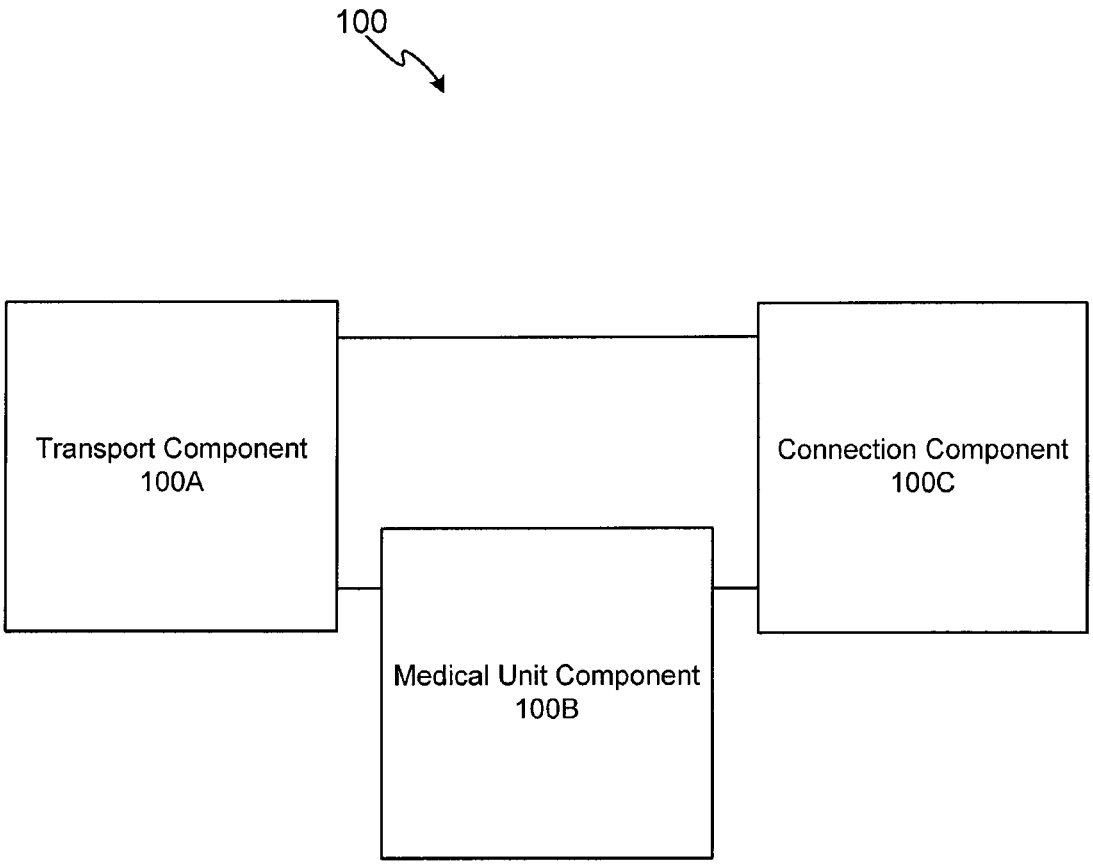
FIG. 1 illustrates a block diagram of a medical unit attachment system in accordance with an exemplary embodiment.

Through use of a medical unit attachment system, such as medical unit attachment system 100 in FIG. 1, various shortcomings of conventional coupling techniques and systems may be overcome. Medical units can be quickly and securely coupled to transports. Loose and/or bulky harnesses can be eliminated. Transport of patients can be achieved faster, potentially improving the quality of medical attention received, and consequently potentially resulting in lives saved. Moreover, medical unit attachment system 100 may be configured to enable these and/or other benefits for various medical units and/or various transports.

Figure 2A:
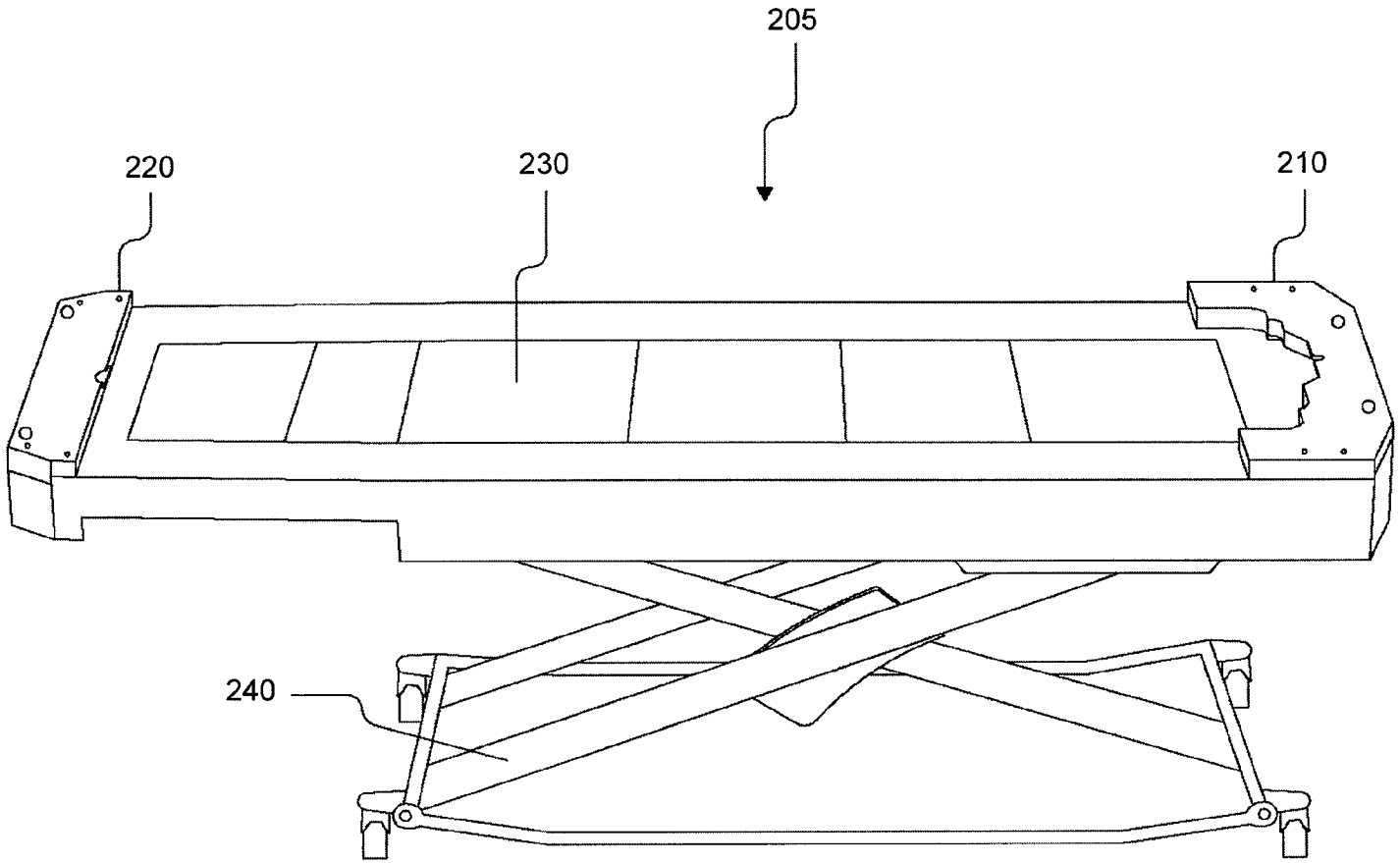
FIG. 2A illustrates a side isometric view of a stretcher with connection brackets in accordance with an exemplary embodiment.
Figure 2B:
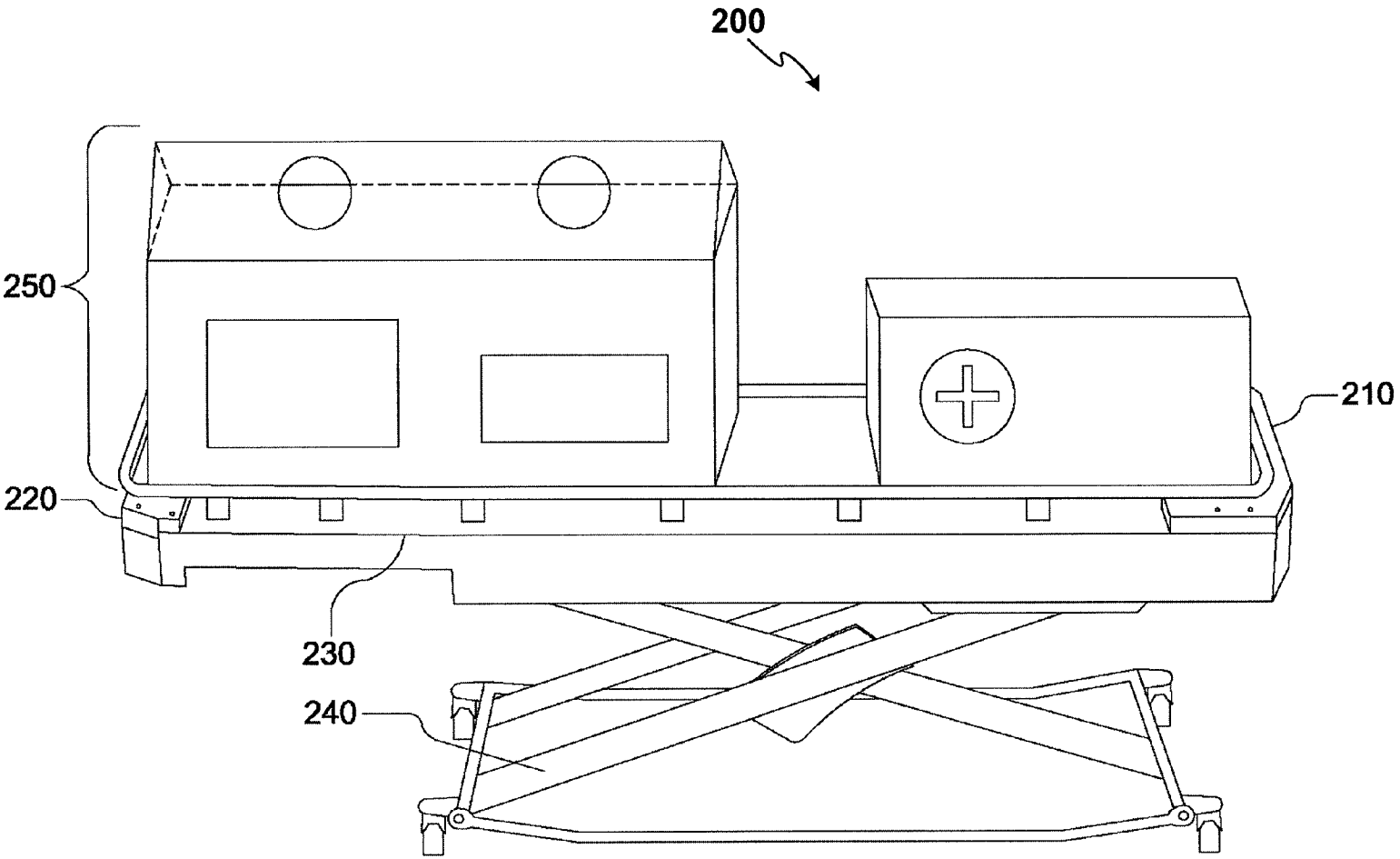
FIG. 2B illustrates a side isometric view of a stretcher and a medical unit attached with connection brackets in accordance with an exemplary embodiment.
Figure 2C:
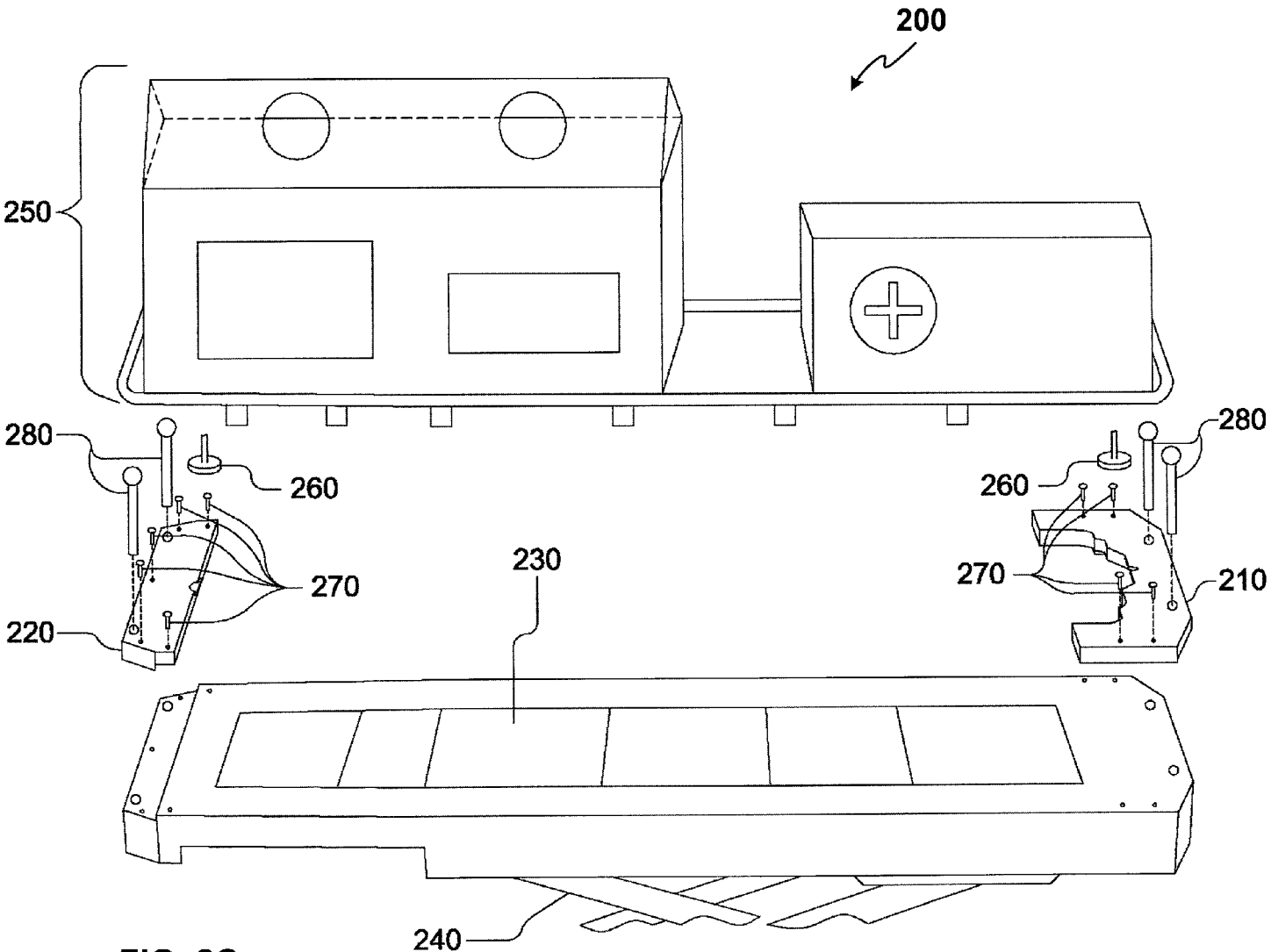
FIG. 2C illustrates an exploded view of a stretcher and a medical unit attached with connection brackets in accordance with an exemplary embodiment.

With reference now to FIGS. 2A, 2B, and 2C, and in accordance with an exemplary embodiment, a medical unit attachment system 100 (for example, medical unit attachment system 200) comprises stretcher 205, medical unit 250, and coupling components 210, 220, 270, 280. Stretcher 205 comprises a first connection bracket 210, a second connection bracket 220, a support surface 230, and a base assembly 240. To form stretcher 205, a commercially available stretcher may be utilized, for example the Power-PRO Incubator Transport™ by Stryker Corporation. Moreover, any suitable stretcher or other mechanism may be utilized. First connection bracket 210 and second connection bracket 220 may be added to stretcher 205. Moreover, in various exemplary embodiments stretcher 205 has first connection bracket 210 and second connection bracket 220 integrated thereto upon initial manufacture.

Medical unit 250 may be any machine, medical equipment, and/or combination and/or collection of the above desired to be securely attached to a transport. In an exemplary embodiment, medical unit 250 comprises a Neonatal Intensive Care Unit (NICU). A NICU provides critical care to infants and typically includes many machines and other equipment. However, medical unit 250 may comprise any support devices, structural components, medical devices, life support systems, isolation systems, and/or the like and/or combinations of the same, as desired. In addition, medical unit 250 may be configured to be securely attached to the floor of a transport, for example an ambulance, a helicopter, an airplane, and/or the like.

With continued reference to FIGS. 2B and 2C, in an exemplary embodiment medical unit 250 securely attaches to a stretcher surface 230 using a first connection bracket 210 and a second connection bracket 220. Medical unit 250 includes a male attachment point 260 which connects with the connection brackets. In an exemplary embodiment, male attachment point 260 is a separate piece fastened to medical unit 250 in preparation for use with connection brackets 210 and 220. In another exemplary embodiment, male attachment point 260 is permanently attached to medical unit 250. In yet another exemplary embodiment, medical unit 250 already includes the male attachment pieces as a part of medical unit 250. In various other exemplary embodiments, medical unit 250 includes a female attachment point configured to connect with a male attachment portion of at least one of connection brackets 210 and 220. Moreover, any suitable structure of medical unit 250 may form an attachment point, and the foregoing examples are by way of illustration and not of limitation.

In an exemplary embodiment, connection brackets 210 and 220 connect to stretcher surface 230 using fasteners 270. Fasteners 270 may comprise any suitable fastening mechanisms or devices, for example: a clevis pin secured by a cotter pin, a pin with a spring-loaded ball and button, a bolt, and/or the like, and/or any other mechanical device configured to couple connection brackets 210 and 220 to at least a portion of stretcher 205. Furthermore, connection brackets 210 and 220 may be secured to stretcher surface 230 using any other suitable mechanisms or devices, for example via hooks, snaps, male/female connections, buckles, interlocking pieces, and/or the like. Moreover, rods 280, for example stretcher push rods, may be used to further secure connection brackets 210 and 220 to a transport and/or maneuver the transport.

Figure 3:
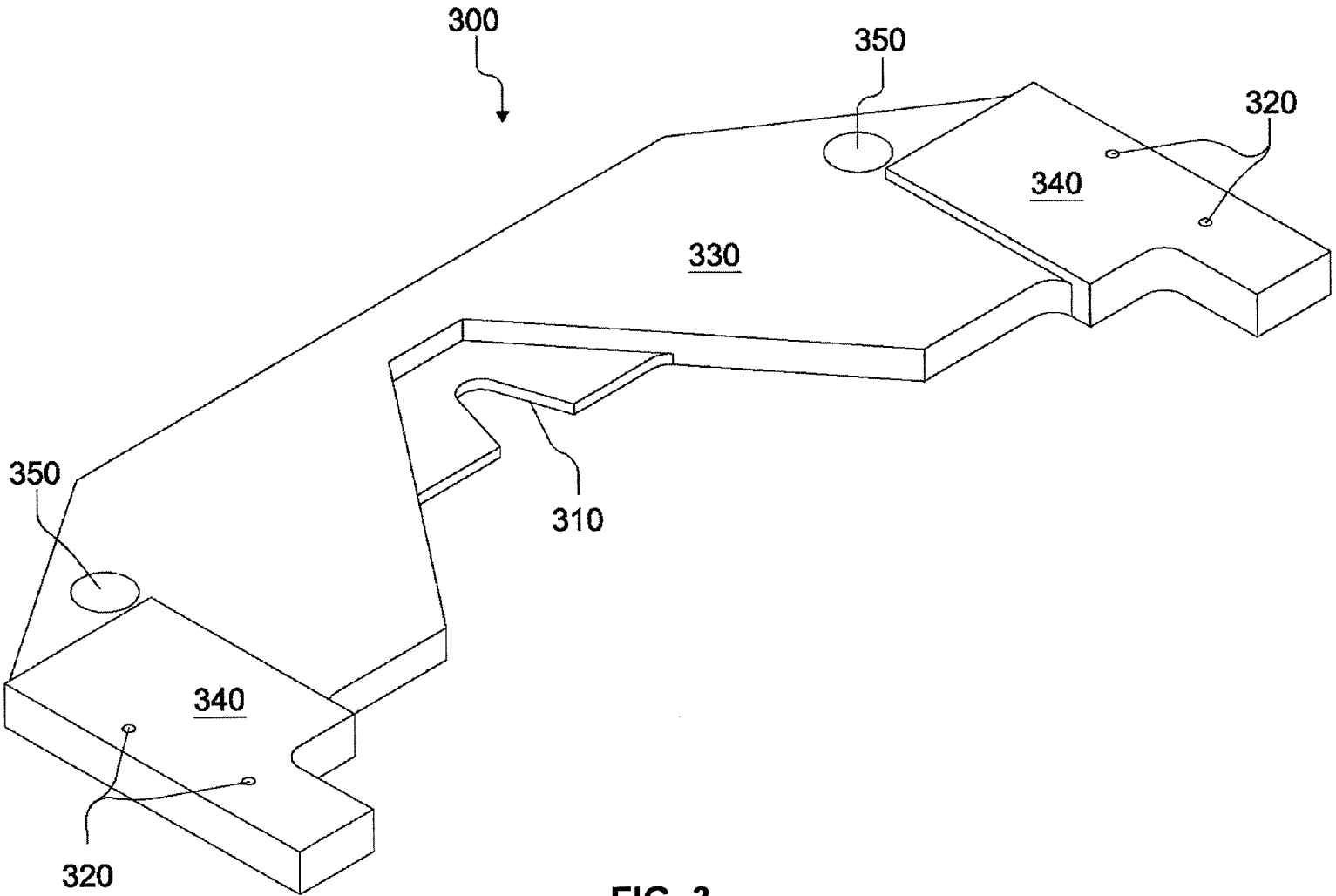
FIG. 3 illustrates a bottom isometric view of a connection bracket in accordance with an exemplary embodiment.

With reference now to FIG. 3, first connection bracket 300 may comprise any suitable structure, components, features, and/or the like configured to facilitate coupling stretcher 205 and medical unit 250. Moreover, first connection bracket 300 may be configured with any suitable shapes, dimensions, layouts, geometries, and/or the like, as desired. In an exemplary embodiment, first connection bracket 300 may include an attachment point 310 and a plurality of attachment points 320. Additionally, first connection bracket 300 may further include a surface 330 and additional elevated surfaces 340. First connection bracket 300 may also include a stretcher push rod opening 350. First connection bracket 300 may comprise any suitable material, for example aluminum, steel, plastic, metal alloys, composite material, wood, rubber, and/or the like, or combinations of the same.

In an exemplary embodiment, attachment point 310 is configured as a notch. Medical unit 250 includes an object configured to at least partially fit the notch in order to securely hold medical unit 250. In another exemplary embodiment, attachment point 310 is configured as a narrow opening, for example a slot. Moreover, attachment point 310 may be configured as any suitable female attachment component. In various other exemplary embodiments, attachment point 310 comprises a protrusion from first connection bracket 300, for example at least one peg. Attachment point 310 may thus comprise any suitable male attachment component, as desired.

In an exemplary embodiment, attachment point 310 attaches to medical unit 250 so that there are at least three sides of contact between medical unit 250 and attachment point 310. In this manner, medical unit 250 is at least partially restricted from moving in three directions. For example, with reference to FIG. 3, a notch attachment point 310 restricts medical unit 250 from shifting in all horizontal directions except the direction in which medical unit 250 was placed in connection with first connection bracket 300. Moreover, if medical unit 250 is resting on a transport and at least a portion of medical unit 250 within attachment point 310 is larger than the vertical opening of attachment point 310, movement in the upward vertical direction is restricted as well.

Continuing to reference FIG. 3, in an exemplary embodiment surface 330 is substantially flat, and is configured with a V-shape in the side facing the middle of the transport. In another exemplary embodiment, surface 330 is configured with a half-circle shape in the side facing the middle of the transport. Moreover, surface 330 may be configured with any dimensions, shapes, angles, and/or the like, or any other structure suitable to at least partially guide a portion of medical unit 250 into contact with first attachment point 310. In an exemplary embodiment, first attachment point 310 is located approximately in the center of connection bracket 300. Furthermore, guiding medical unit 250 toward first attachment point 310 may either be a two-dimensional or three-dimensional process. In the three-dimensional approach, the added dimension comprises vertical guidance towards and/or away from the transport.

In various exemplary embodiments, first connection bracket 300 includes one or more elevated surfaces 340. Elevated surfaces 340 create edges on the bottom of first connection bracket 300 which may correspond to the contours of a transport surface. Elevated surfaces 340 correspondingly provide increased stability of first connection bracket 300 and attached medical unit 250 by adding additional areas of movement restriction. Furthermore, in an exemplary embodiment, elevated surfaces 340 provide additional surface area connection between first connection bracket 300 and a transport. The additional surface area connection increases the strength and stability of the connection between first connection bracket 300 and a transport. In addition, in various exemplary embodiments, elevated surfaces 340 and the contours of a transport surface create guidance for rapid and correct alignment of first connection bracket 300 and a transport.

Continuing to reference FIG. 3, in an exemplary embodiment, first connection bracket comprises attachment points 320. Attachment points 320 may comprise holes in first connection bracket 300 configured to accept insertion of a fastener. By making first connection bracket 300 removable, medical unit attachment system 100 achieves the ability to attach a medical unit to a transport from multiple directions. Moreover, depending on the transport layout, it may be advantageous to attach first connection bracket 300 last in the process. In another exemplary embodiment, first connection bracket 300 is not removed from the transport during its use, so first connection bracket 300 can be permanently attached to the transport.

Figure 4:
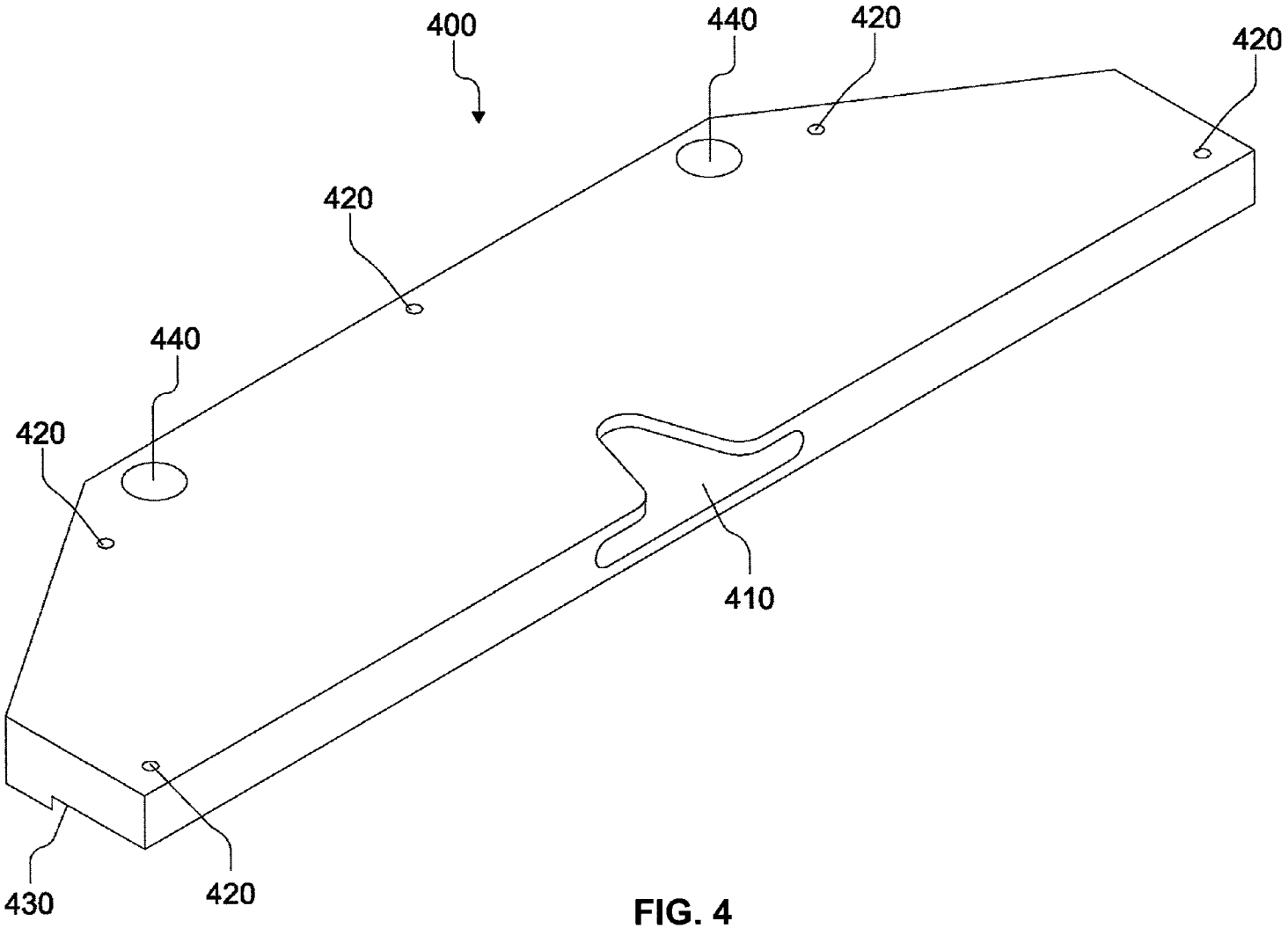
FIG. 4 illustrates a top isometric view of a corresponding connection bracket in accordance with an exemplary embodiment.

Turning now to FIG. 4, second connection bracket 400 may comprise any suitable structure, components, features, and/or the like configured to facilitate coupling stretcher 205 and medical unit 250. Moreover, second connection bracket 400 may be configured with any suitable shapes, dimensions, layouts, geometries, and/or the like, as desired. In an exemplary embodiment, second connection bracket 400 includes a second attachment point 410 and at least two attachment points 420. Furthermore, second connection bracket 400 may include a formed surface 430. Second connection bracket 400 may further include a stretcher push rod opening 440, for example an opening configured to receive rod 280 as illustrated in FIG. 2B. Second attachment point 410 may be configured as a combination of a notch and a slot, having an enclosure on five sides with an opening on the sixth side and a notch on the top side. In an exemplary embodiment, second attachment point 410 comprises a notch, and medical unit 250 comprises an attachment point which at least partially fits the notch to securely hold medical unit 250. In another exemplary embodiment, second attachment point 410 comprises a slot. Furthermore, second attachment point 410 may comprise any suitable female attachment. In another exemplary embodiment, second attachment point 410 comprises a protrusion from second connection bracket 400. For example, second attachment point 410 may include at least one peg. Furthermore, second attachment point 410 may comprise any suitable male attachment. Moreover, in various exemplary embodiments, first connection bracket 300 and second connection bracket 400 are configured with two or more corresponding first attachment points 310 and/or second attachment points 410.

In certain exemplary embodiments, second attachment point 410 is configured to couple to an attachment point on medical unit 250 in a manner such that at least three sides of second attachment point 410 are in contact with second attachment point 410. In this manner, movement of medical unit 250 is restricted in three directions. For example, a second attachment point 410 configured as a notch restricts medical unit 250 from shifting in all horizontal directions except the direction in which medical unit 250 was placed in connection with second connection bracket 400. Moreover, if medical unit 250 is resting on a transport and at least a portion of medical unit 250 coupled to second attachment point 410 is larger than attachment point 410, movement in the vertical direction may be restricted as well. For example, second attachment point 410 may be placed at a position of medical unit 250, for example attachment point where maximum contact is made. If a portion of medical unit 250 configured for insertion into the opening of attachment point 410 is larger than the notch, medical unit 250 may be restricted from movement in the upward vertical direction.

Attachment points 420 may comprise holes in second connection bracket 400 configured for the insertion of a fastener. The fastener may comprise any suitable fastening means, for example: a clevis pin secured by a cotter pin, a pin with a spring-loaded ball and button, a bolt, and/or the like, and/or any other mechanical device configured to hold a transport and second connection bracket 400 together. Furthermore, second connection bracket 400 can be secured to a transport using any suitable means, for example hooks, snaps, male/female connections, buckles, interlocking pieces, and/or the like, or combinations of the same. Moreover, the fastener may be any device suitable for quick attachment and/or removal of second connection bracket 400 from a transport.

Continuing to reference FIG. 4, in an exemplary embodiment second connection bracket 400 comprises formed surface 430. Formed surface 430 may comprise specific shapes, dimensions, protrusions, and/or other formatting designed to at least partially correspond to the contours of transport surface 230. In this manner, formed surface 430 increases the stability strength, and/or alignment of second connection bracket 400 and medical unit 250 by adding an area of movement restriction. Formed surface 430 thus also provides additional surface area connection between second connection bracket 400 and a transport. The additional surface area connection increases the strength and stability of connection between second connection bracket 400 and a transport. In addition, formed surface 430 and the contours of transport surface 230 create guidance for rapid and correct alignment of second connection bracket 400 and a transport.

As previously discussed, first connection bracket 300 and/or second connection bracket 400 may comprise one or more stretcher push rod openings 350 and/or 440, respectively. A push-rod is a pole which connects to a stretcher, allowing for easier transporting and maneuvering of the stretcher. In an exemplary embodiment, connecting a push-rod to a stretcher through one or more of push-rod openings 350 and/or 440 adds an additional point of securing connection brackets 300 and/or 400 to the stretcher.

Transporting a medical unit, for example medical unit 250, from one location to another is typically a critical situation where time is of the essence. It is important to rapidly transport the medical unit and it is important for the medical unit to be securely attached to a mode of transportation. Therefore, in accordance with an exemplary embodiment, connecting a medical unit to a transport in a quick, secure, and safe manner is facilitated via use of a medical unit attachment system 100. In an exemplary embodiment, a mode of transportation may include a stretcher, an ambulance, a helicopter, and/or any other suitable mode of transportation.

Figure 5B:
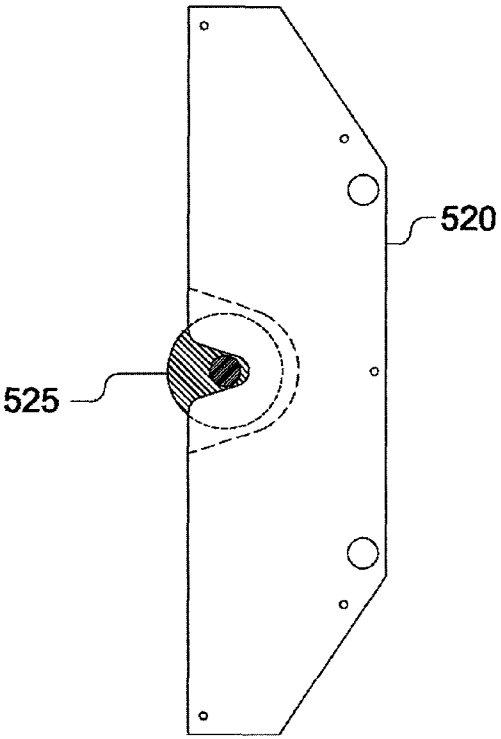
FIG. 5B illustrates a top and side view of the connection of a medical unit and a second connection bracket in accordance with an exemplary embodiment.
Figure 5B:
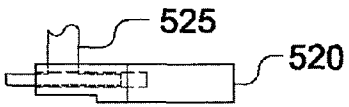
Figure 5A:
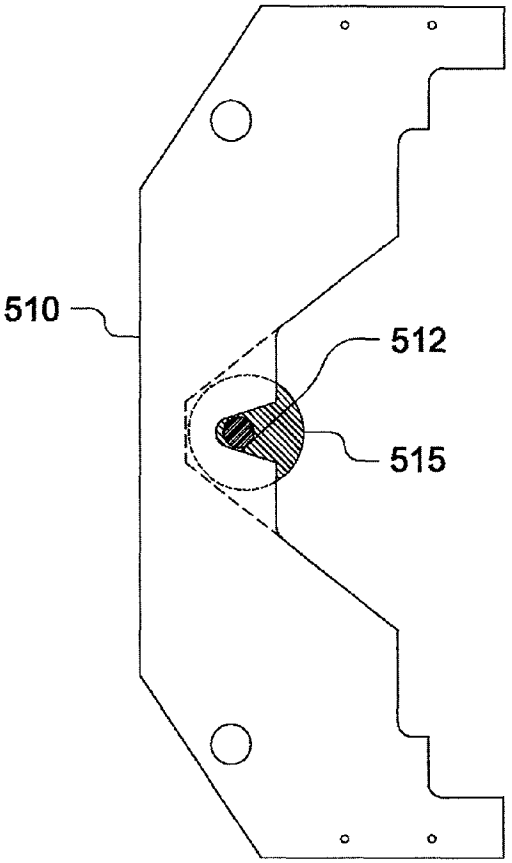
FIG. 5A illustrates a top and side view of the connection of a medical unit and a first connection bracket in accordance with an exemplary embodiment.
Figure 5A:
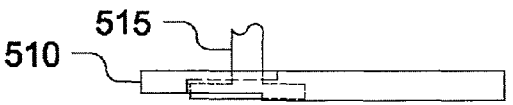

Turning now to FIGS. 5A and 5B, in accordance with an exemplary embodiment, medical unit attachment points may be in communication with connection brackets 300 and/or 400. With reference to FIG. 5A, first connection bracket 510 attaches with a first attachment point 515 at an attachment point 512. In an exemplary embodiment, first attachment point 515 comprises a disc with a protruding rod. The disc portion of first attachment point 515 slides underneath attachment point 512 of first connection bracket 510. In this manner, the disc is in contact with at least three sides of first connection bracket 510. The rod portion of first attachment point 515 connects to attachment point 512. First attachment point 515 may thus rest on a transport surface, and first connection bracket 510 restricts movement of first attachment point 515 in both horizontal and vertical directions.

With reference to FIG. 5B, second connection bracket 520 attaches with a second attachment point 525. In an exemplary embodiment, second attachment point 525 comprises a disc with a protruding rod. In another exemplary embodiment, second attachment point 525 is in contact with second connection bracket 520 on five sides, not including the side in which second attachment point 525 is inserted.

In this manner, a stable connection is facilitated between a patient all the way through a transport, including various structure between, including one or more of the medical unit, the attachment points, the brackets, and the fasteners. Moreover, stability may be increased by designing attachment points 515 and/or 525 with increased surface area configured to contact one or more of connection bracket 510, connection bracket 520, and the transport.

For example, when both a first and second connection bracket connect to a transport and a medical unit attaches to the connection brackets, the medical unit is secure and is at least partially restricted from movement in all directions. In an exemplary embodiment, the attachment points of connection brackets 510 and 520 face each other. In this configuration, the unrestricted directions of movement of each connection bracket (stated another way, the directions in which the attachment point enters the attachment point) are opposite each other. Therefore, a medical unit is secure and has restricted movement in a full 360 degrees in all directions.

Figure 6:
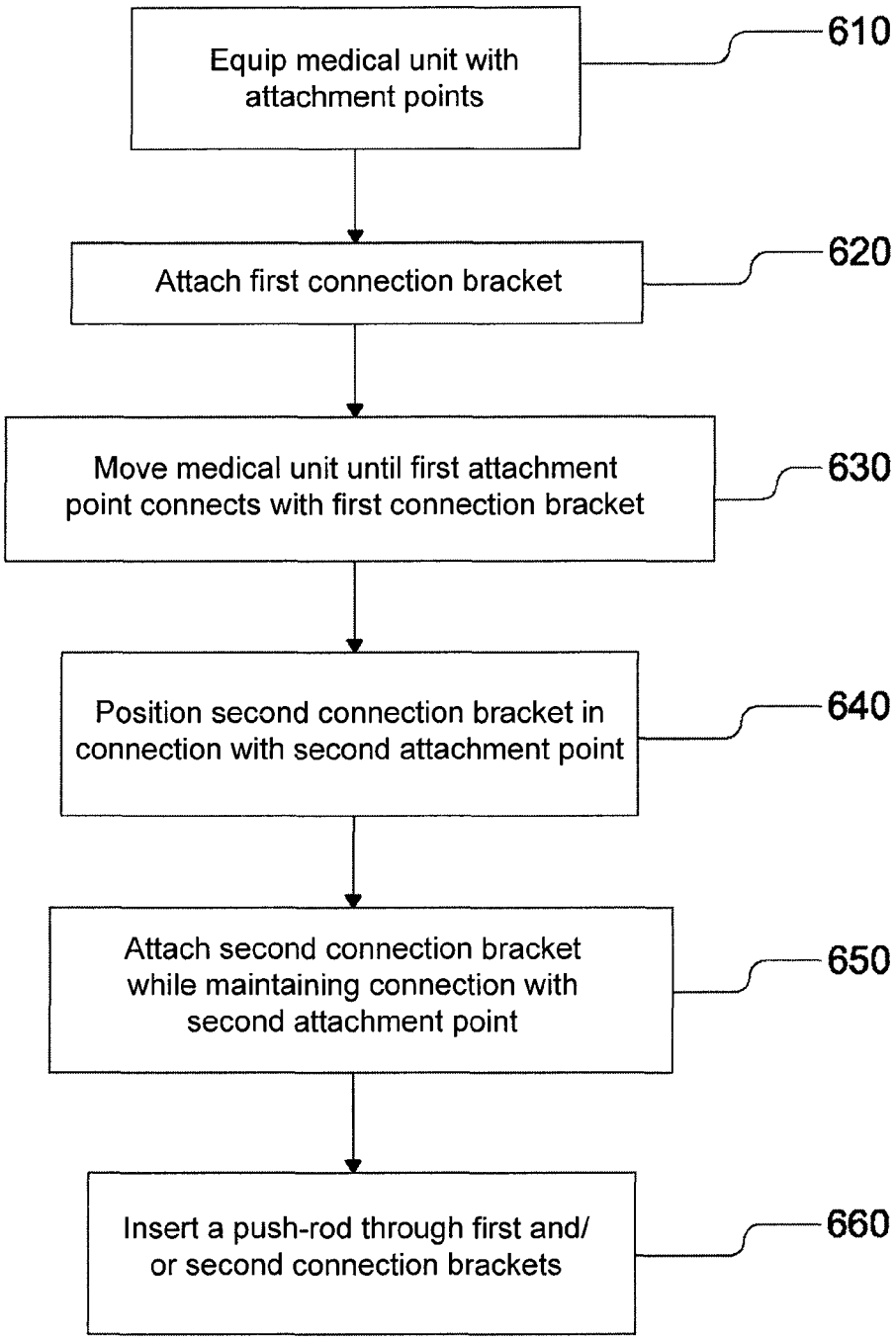
FIG. 6 illustrates a flow chart of a method for attaching a medical unit to a transport in accordance with an exemplary embodiment.

A method for coupling a medical unit to a transport may comprise any suitable steps and/or elements, as desired. Turning now to FIG. 6, in an exemplary embodiment, a medical unit is equipped with at least two objects (step 610). These objects, at least one at either end of the medical unit, are configured to be attachment points of the medical unit to the connection brackets. A first connection bracket is connected to a transport (step 620). The first connection bracket is oriented so that a corresponding attachment point is facing the middle of the transport. Then, the medical unit is positioned so that one of the objects attaches to the first connection bracket (step 630). At this point, the remaining objects and the other half of the medical unit may still be moved to some degree. The medical unit is positioned on top of the transport. A second connection bracket is positioned to attach to at least one of the remaining objects (step 640). Once one of the remaining objects and the second connection bracket are attached, the second connection bracket is maneuvered onto the transport in the proper location to connect to the transport while maintaining contact with the medical unit (step 650). The second connection bracket is connected to the transport, for example using four clevis pins. At this point, the medical unit has been securely attached to the transport in a quick and safe manner. Additionally, as noted previously, one or more push-rods may also be inserted into the first and/or second connection bracket (step 660). Moreover, the above steps may be performed in various orders, as desired. For example, a second connection bracket may be connected to a transport prior to a first connection bracket being connected to a transport, and so forth.

In various exemplary embodiments, the objects connecting to medical unit 250 protrude from the bottom of medical unit 250. Additionally, connection brackets 300 and 400 connect to the top support surface of the transport. Once medical unit 250 is securely on the transport, all the attachment points are underneath the medical unit, and are thus in a position where likelihood of disturbing or damaging them is reduced. In contrast, prior attempts to secure a medical unit often utilized straps placed across the medical unit. These straps were tied to a transport, and were prone to damage and/or inadvertent release.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

In the foregoing specification, the invention has been described with reference to various embodiments. However, one of ordinary skill in the art appreciates that various modifications and changes can be made without departing from the scope of the present invention as set forth in the claims below. Accordingly, the specification is to be regarded in an illustrative rather than a restrictive sense, and all such modifications are intended to be included within the scope of the present invention. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A medical unit attachment system, comprising:

a transport having a first end and a second end;

a connection system having a first bracket and a second bracket, wherein said first bracket securely connects to said first end of said transport, and wherein said second bracket securely connects to said second end of said transport; and a medical unit having a first end, a second end, a first attachment point, and a second attachment point;

wherein said first attachment point connects to said first end and said second attachment point connects to said second end, wherein said first attachment point attaches to said first bracket and said second attachment point attaches to said second bracket in order to facilitate securing said medical unit to said transport, wherein each of said first bracket and said second bracket include a notch;

wherein said first attachment point and said second attachment point are each a disc; and wherein said first attachment point and said second attachment point each fit within said notch of each of said first bracket and said second bracket.

2. A medical unit attachment system, comprising:

a transport having a first end and a second end;

a connection system having a first bracket and a second bracket, wherein said first bracket securely connects to said first end of said transport, and wherein said second bracket securely connects to said second end of said transport; and a medical unit having a first end, a second end, a first attachment point, and a second attachment point;

wherein said first attachment point connects to said first end and said second attachment point connects to said second end, wherein said first attachment point attaches to said first bracket and said second attachment point attaches to said second bracket in order to facilitate securing said medical unit to said transport, wherein said first attachment point and said second attachment point each comprise a top side and a bottom side;

wherein said first bracket at least partially encloses the top side of said first attachment point when attached; and wherein said second bracket at least partially encloses the top side of said second attachment point when attached.

3. The system of claim 2, wherein each bottom side of said first and second attachment point is wider than the respective top side.

4. The system of claim 2, wherein said first bracket and said second bracket are connected to said transport with a fastener.

5. The system of claim 4, wherein said fastener is at least one of: a clevis pin, a cotter pin, a hook, a snap, a buckle, an interlocking piece, or a male/female connection.

6. The system of claim 2, wherein said attachment system includes at least one of: aluminum, plastic, metal alloy, composite material, wood, or rubber.

7. The system of claim 2, wherein said first bracket and said second bracket each further comprise an opening for the insertion of a push-rod.

8. The system of claim 2, wherein said medical unit includes a neonatal intensive care unit.

9. A method of attaching a medical unit to a transport, the method comprising:

equipping said medical unit with a first attachment point and a second attachment point;

attaching a first connection bracket to a first end of said transport;

moving said medical unit in a direction substantially coplanar with said first connection bracket until said first attachment point connects to said first connection bracket;

positioning a second connection bracket in connection with said second attachment point; and attaching said second connection bracket to a second end of said transport while maintaining the connection between said second connection bracket and said second attachment point.

10. The method of claim 9, further comprising inserting a push-rod through at least one of said first connection bracket or said second connection bracket.

11. The method of claim 9, further comprising using at least one fastener to attach said first connection bracket and said second connection bracket to said transport.

12. The method of claim 11, wherein said fastener includes at least one of: a clevis pin, a cotter pin, a hook, a snap, a buckle, an interlocking piece, or a male/female connection.

13. The method of claim 9, wherein said first attachment point and said second attachment point each comprise a top side and a bottom side;

wherein said first connection bracket at least partially encloses the top side of said first attachment point when attached; and wherein said second connection bracket at least partially encloses the top side of said second attachment point when attached.

14. The method of claim 13, wherein each bottom side of said first and second attachment point is wider than the respective top side.

15. The method of claim 9, wherein said medical unit comprises at least one of: a neonatal intensive care unit, a life support device, an intensive care unit, or a medical isolation system.

16. The method of claim 9, wherein said transport includes at least one of a stretcher, an ambulance, a helicopter, or an airplane.

17. A method of attaching a medical unit to a transport, the method comprising:

equipping a bottom plane of said medical unit with a first attachment point and a second attachment point;

attaching a first connection bracket to a top plane of said transport at a first end of said transport;

moving said medical unit in a direction substantially parallel with the top plane of said transport until said first attachment point at least partially connects to said first connection bracket of said transport;

moving said medical unit to substantially align the bottom plane to the top plane;

moving a second connection bracket until said second connection bracket at least partially connects to said second attachment point; and attaching said second connection bracket to said transport at a second end of said transport while maintaining the connection between said second connection bracket and said second attachment point.

18. The method of claim 17, further comprising guiding said medical unit into position for a connection between at least one of said first attachment point and said first connection bracket, or said second attachment point and said second connection bracket.

* * * * *